US006743506B2

(12) United States Patent
Bond et al.

(10) Patent No.: US 6,743,506 B2
(45) **Date of Patent: *Jun. 1, 2004**

(54) HIGH ELONGATION SPLITTABLE MULTICOMPONENT FIBERS COMPRISING STARCH AND POLYMERS

(75) Inventors: Eric Bryan Bond, Maineville, OH (US); Daniel Steven Wheeler, Cincinnati, OH (US); Kelyn Anne Arora, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/294,544

(22) Filed: Nov. 14, 2002

(65) Prior Publication Data

US 2003/0091822 A1 May 15, 2003

Related U.S. Application Data

(63) Continuation-in-part of application No. 09/853,131, filed on May 10, 2001, now abandoned, which is a continuation-in-part of application No. 09/852,888, filed on May 10, 2003.

(51) Int. Cl.[7] ..... D01F 8/00

(52) U.S. Cl. ..... 428/370; 428/373; 428/374

(58) Field of Search ..... 428/370, 373, 428/374

(56) References Cited

U.S. PATENT DOCUMENTS

| | | | |
|---|---|---|---|
| 4,139,699 | A | 2/1979 | Hernandez et al. |
| 4,853,168 | A | 8/1989 | Eden et al. |
| 5,316,578 | A | 5/1994 | Buehler et al. |

(List continued on next page.)

FOREIGN PATENT DOCUMENTS

| | | |
|---|---|---|
| EP | 1035163 | 9/2000 |
| EP | 1035239 | 9/2000 |
| EP | 1217106 | 6/2002 |

(List continued on next page.)

OTHER PUBLICATIONS

Fringant, C., et al., "Preparation of Mixed Esters of Starch of Use of an External Plasticizer: Two Different Ways to Change the Properties of Starch Acetate Films", Carbohydrate Polymers 35 (1998) 97–106, Elsevier Science, Ltd.

Glenn, G. M., et al., "Starch, Fiber and $CaCO_3$ Effects on the Physical Properties of Foams Made by a Baking Process," Industrial Crops and Products 14 (2001) 201–212, Elsevier Science, Ltd.

Jandura, P., et al., "Thermal Degradation Behavior of Cellulose Fibers Partially Esterified with Some Long Chain Organic Acids", Polymer Degradation and Stability 70 (2000) 387–394, Elsevier Science, Ltd.

*Primary Examiner*—N. Edwards
(74) *Attorney, Agent, or Firm*—Angela Marie Stone; Leonard W. Lewis

(57) ABSTRACT

Splittable multicomponent fibers, to split fibers made from such splittable fibers, to a processes for making such splittable and split fibers, and to nonwovens and other substrates made form the split fibers. The splittable multicomponent fibers can comprise one component comprising thermoplastic starch and another component comprising a non-starch thermoplastic polymer, wherein: (i) said second component is capable of being split or removed from said first component to provide at least one split fiber consisting essentially of said first component; and (ii) wherein the split fiber of said first component can have good elongation properties. The splittable multicomponent fibers can also provide split fibers of the thermoplastic starch component. The split fibers corresponding to the thermoplastic polymer component will have a greater elongation than directly spun thermoplastic fibers which have an equivalent mass through put as the thermoplastic polymer component of the multicomponent fiber and which have the same diameter as the split fiber.

18 Claims, 2 Drawing Sheets

U.S. PATENT DOCUMENTS

| | | | |
|---|---|---|---|
| 5,417,679 | A | 5/1995 | Toms et al. |
| 5,422,387 | A | 6/1995 | Toms et al. |
| 5,425,987 | A | 6/1995 | Shawver et al. |
| 5,516,815 | A | 5/1996 | Buehler et al. |
| 5,593,768 | A | 1/1997 | Gessner |
| 5,593,778 | A | 1/1997 | Kondo et al. |
| 5,703,160 | A | 12/1997 | Dehennau et al. |
| 5,814,404 | A | 9/1998 | Rutherford et al. |
| 5,851,937 | A | 12/1998 | Wu et al. |
| 5,874,486 | A | 2/1999 | Bastioli et al. |
| 5,945,480 | A | 8/1999 | Wang et al. |
| 5,985,776 | A | 11/1999 | Bertrand et al. |
| 6,045,908 | A | 4/2000 | Nakajima et al. |
| 6,096,809 | A | 8/2000 | Lorcks et al. |
| 6,117,925 | A | 9/2000 | Tomka |
| 6,218,321 | B1 | 4/2001 | Lorcks et al. |
| 6,316,578 | B1 | 11/2001 | McCloskey et al. |
| 6,376,072 | B1 | 4/2002 | Evans et al. |
| 6,451,170 | B1 | 9/2002 | Anderson et al. |

FOREIGN PATENT DOCUMENTS

| | | |
|---|---|---|
| EP | 1217107 | 6/2002 |
| GB | 1 247 474 | 9/1971 |
| JP | 62028410 | 2/1987 |
| JP | 04100913 | 4/1992 |
| JP | 8027627 | 1/1996 |
| JP | 9041224 | 2/1997 |
| JP | 9276331 | 10/1997 |
| JP | 10008364 | 1/1998 |
| WO | WO 01/46506 A2 | 6/2001 |
| WO | WO 01/48078 A1 | 7/2001 |
| WO | WO 01/49912 A1 | 7/2001 |

HIGH ELONGATION SPLITTABLE MULTICOMPONENT FIBERS COMPRISING STARCH AND POLYMERS

CROSS REFERENCE TO RELATED PATENTS

This application is a continuation-in-part and claims priority to co-pending and commonly owned U.S. application Ser. Nos. 09/853,131 and 09/852,888, both filed May 10, 2001 now abandoned.

FIELD OF THE INVENTION

The present invention relates to splittable multicomponent fibers comprising starch and polymers and split fibers obtained from such splittable fibers. The present invention also relates to a process for making split fibers. The split fibers can have high elongation and can be used to make nonwoven webs and disposable articles.

BACKGROUND OF THE INVENTION

There is a need for nonwovens that can deliver softness and extensibility. Soft nonwovens are gentle to the skin and are particularly useful in disposable products. Generally, decreasing fiber diameters can improve softness of nonwovens and other substrates. Nonwovens that are capable of high extensibility at relatively low force are also desired. These can be used to provide sustained fit in products and facilitate the use of various mechanical post-treatments. Typically, it has been found that having both small fiber diameter and high extensibility is difficult to achieve. This is because when the fiber diameter is reduced, it is commonly because the spinning speed or draw ratio has been increased which decreases extensibility of the fiber. Other ways to increase fiber extensibility of fine fibers include using higher-cost materials and or special mixing requirements.

There exists today a need for extensible nonwovens made with fine fibers that can be made with convention thermoplastic polymers, as well as for fibers that can be used to make such nonwovens and other substrates. The present invention can provide small diameter, extensible fibers in the form of split fibers obtained from splittable fibers splittable fibers that are cost-effective and easily processable. The splittable fibers are made of natural starches and thermoplastic polymers. The present invention also provides nonwoven articles and other substrates made from such split fibers.

SUMMARY OF THE INVENTION

The present invention is directed to splittable multicomponent fibers, to split fibers made from such splittable fibers, to a processes for making such splittable and split fibers, and to nonwovens and other substrates made from the split fibers. The splittable multicomponent fibers can comprise at least one nonencompassed segment of one component comprising thermoplastic starch and at least one nonencompassed segment of another component comprising a non-starch thermoplastic polymer, wherein: (i) said second component is capable of being split or removed from said first component to provide at least one split fiber consisting essentially of said first component; and (ii) wherein the split fiber of said first component has an Elongation to Break Ratio of greater than 1.0. As used herein, "nonencompassed segment" means that the segment of the multicomponent fiber has at least one region of its lateral surface that is not encompassed by another segment of the multicomponent fiber. The splittable multicomponent fiber will produce at least one split fiber comprising the thermoplastic polymer, and can also produce a plurality of split thermoplastic polymer fibers. The splittable multicomponent fibers can also produce split fibers comprising the thermoplastic starch component. The split fibers corresponding to the thermoplastic polymer component will have a greater elongation than directly spun thermoplastic fibers which have an equivalent mass through put as the thermoplastic polymer component of the multicomponent fiber and which have the same diameter as the split fiber. This allows small diameter fiber to be produced at low spinning speed, so as to provide improved elongation properties, compared to conventional methods whereby cost effective processes run at high spinning speeds tend to result in poorer elongation properties, or wherein formation of small diameter fibers with good elongation are typically made according to processes with low mass through-put, and consequently low cost effectiveness.

The configuration of the splittable multicomponent fibers may be side-by-side, segmented pie, hollow segmented pie, islands-in-the-sea, segmented ribbon, tipped multilobal, or any combination of configurations. In general, segments will split or be splittable from adjacent segments of the fiber wherein the adjacent segment or segments constitute a different component of the multicomponent fiber.

The split fibers can be obtained from the multicomponent fibers hereof via chemical, mechanical, thermal, or other processes. Split fibers can also be obtained immediately upon formation of the multicomponent fiber, upon exit from the spinneret capillaries. The splittable nature of the fibers hereof is due at least in part to differences in rheological, thermal, solubility, surface energy, extensibility and/or solidification differential behavior between the components of the multicomponent fiber.

Without intending to be limited to any particular theory, it is believed that the splittable multicomponent fibers provide improved extensibility in the split fibers because they can be spun under conditions such that the fibers have relatively low molecular orientation and relatively large diameters. This can occur by using relatively slow spinning speeds, not subjecting the fibers to large drawing forces, and/or by increasing the through put per hole in the spinneret. Typically, fibers are drawn to smaller fiber diameters to increase the fiber strength and for a softer feel when used in a nonwoven. The drawing process, however, increases molecular orientation which results in a decrease in elongation to break of the fibers. Therefore, the split fibers of the present invention will have a higher elongation to break compared to fibers of the same diameter produced by direct spinning at equivalent mass through-put. In addition, the split fibers of the present invention can also have improved softness when used in a nonwoven fabric as a result of the improved extensibility.

The present invention is also directed to nonwoven webs and disposable articles comprising the split fibers. The nonwoven webs may also contain other synthetic or natural fibers blended with the split fibers of the present invention.

BRIEF DESCRIPTION OF THE DRAWINGS

These and other features, aspects, and advantages of the present invention will become better understood with regard to the following description, appended claims, and accompanying drawings where:

FIG. 4 is a cross-sectional view of a splittable fiber with a cross-sectional view of a bicomponent fiber having a side-by-side configuration.

DETAILED DESCRIPTION OF THE INVENTION

Figure 1:
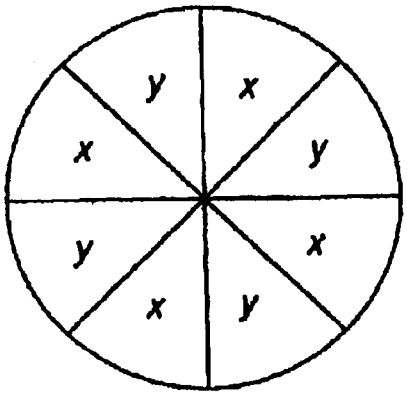
FIG. 1 is a cross-sectional view of a splittable fiber with a solid eight segmented pie configuration.

All percentages, ratios and proportions used herein are by weight percent of the composition, unless otherwise specified. All average values are calculated "by weight" of the composition or components thereof, unless otherwise expressly indicated. "Average molecular weight", or "molecular weight" for polymers, unless otherwise indicated, refers to number average molecular weight. Number average molecular weight, unless otherwise specified, is determined by gel permeation chromatography. All patents or other publications cited herein are incorporated herein by reference with respect to all text contained therein for the purposes for which the reference was cited. Inclusion of any such patents or publications is not intended to be an admission that the cited reference is citable as prior art or that the subject matter therein is material prior art against the present invention. The compositions, products, and processes described herein may comprise, consist essentially of, or consist of any or all of the required and/or optional components, ingredients, compositions, or steps described herein.

The specification contains a detailed description of (1) materials of the present invention, (2) configuration of the multicomponent fibers, (3) material properties of the multicomponent fiber and split fibers, (4) processes, and (5) articles.

(1) Materials

Component A: Thermoplastic Polymers

Suitable melting temperatures of the thermoplastic polymers, as well as the thermoplastic polymer component, are from about 60° C. to about 300° C., preferably from about 80° C. to about 250° C. and preferably from 100° C.-215° C. Thermoplastic polymers having a melting temperature (Tm) above 250° C. may be used if plasticizers or diluents or other polymers are used to lower the observed melting temperature, such that the melting temperature of the composition of the thermoplastic polymer-containing component is within the above ranges. It may be desired to use a thermoplastic polymer having a glass transition (Tg) temperature of less than 0° C. The thermoplastic polymer component has Theological characteristics suitable for melt spinning. The molecular weight of the polymer should be sufficiently high to enable entanglement between polymer molecules and yet low enough to be melt spinnable. For melt spinning, suitable thermoplastic polymers can have molecular weights about 1,000,000 g/mol or below, preferably from about 5,000 g/mol to about 800,000 g/mol, more preferable from about 10,000 g/mol to about 700,000 g/mol and most preferably from about 20,000 g/mol to about 500,000 g/mol.

The thermoplastic polymers desirably should be able to solidify fairly rapidly, preferably under extensional flow, as typically encountered in known processes as staple fibers (spin draw process) or spunbond/meltblown continuous filament process, and desirably can form a thermally stable fiber structure. "Thermally stable fiber structure" as used herein is defined as not exhibiting significant melting or dimensional change at 25° C. and ambient atmospheric pressure over a period of 24 hours at 50% relative humidity when diameter is measured and the fibers are placed in the environment within five minutes of their formation. Dimensional changes in measured fiber diameter greater than 25% difference, using as a basis the corresponding, original fiber diameter measurement, would be considered significant. If the original fiber is not round, the shortest diameter should be used for the calculation. The shortest diameter should also be used for the 24 hour measurement also.

Suitable thermoplastic polymers include polyolefins such as polyethylene or copolymers thereof, including low, high, linear low, or ultra low density polyethylenes, polypropylene or copolymers thereof, including atactic polypropylene; polybutylene or copolymers thereof; polyamides or copolymers thereof, such as Nylon 6, Nylon 11, Nylon 12, Nylon 46, Nylon 66; polyesters or copolymers thereof, such as polyethylene terephthalates; olefin carboxylic acid copolymers such as ethylene/acrylic acid copolymer, ethylene/maleic acid copolymer, ethylene/methacrylic acid copolymer, ethylene/vinyl acetate copolymers or combinations thereof; polyacrylates, polymethacrylates, and their copolymers such as poly(methyl methacrylates). Other non-limiting examples of polymers include polycarbonates, polyvinyl acetates, poly(oxymethylene), styrene copolymers, polyacrylates, polymethacrylates, poly(methyl methacrylates), polystyrene/methyl methacrylate copolymers, polyetherimides, polysulfones, or combinations thereof. In some embodiments, thermoplastic polymers include polypropylene, polyethylene, polyamides, polyvinyl alcohol, ethylene acrylic acid, polyolefin carboxylic acid copolymers, polyesters, and combinations thereof.

Biodegradable thermoplastic polymers are also suitable for use herein. Biodegradable materials are susceptible to being assimilated by microorganisms such as molds, fungi, and bacteria when the biodegradable material is buried in the ground or otherwise comes in contact with the microorganisms including contact under environmental conditions conducive to the growth of the microorganisms. Suitable biodegradable polymers also include those biodegradable materials which are environmentally degradable using aerobic or anaerobic digestion procedures, or by virtue of being exposed to environmental elements such as sunlight, rain, moisture, wind, temperature, and the like. The biodegradable thermoplastic polymers can be used individually or as a combination of biodegradable or non-biodegradable polymers. Biodegradable polymers include polyesters containing aliphatic components. Among the polyesters are ester polycondensates containing aliphatic constituents and poly (hydroxycarboxylic) acid. The ester polycondensates include diacids/diol aliphatic polyesters such as polybutylene succinate, polybutylene succinate co-adipate, aliphatic/aromatic polyesters such as terpolymers made of butylenes diol, adipic acid and terephthalic acid. The poly (hydroxycarboxylic) acids include lactic acid based homopolymers and copolymers, polyhydroxybutyrate (PHB), or other polyhydroxyalkanoate homopolymers and copolymers. Such polyhydroxyalkanoates include copolymers of PHB with higher chain length monomers, such as C6–C12, and higher, polyhydroxyalkanaotes, such as disclosed in U.S. Patent Re. 36,548 and U.S. Pat. No. 5,990,271.

An example of a suitable commercially available poly lactic acid is NATUREWORKS from Cargill Dow and LACEA from Mitsui Chemical. An example of a suitable commercially available diacid/diol aliphatic polyester is the polybutylene succinate/adipate copolymers sold as BIONOLLE 1000 and BIONOLLE 3000 from the Showa High Polymer Company, Ltd. Located in Tokyo, Japan. An example of a suitable commercially available aliphatic/aromatic copolyester is the poly(tetramethylene adipate-co-terephthalate) sold as EASTAR BIO Copolyester from Eastman Chemical or ECOFLEX from BASF.

The selection of the polymer and amount of polymer will effect the softness, texture, and properties of the final product as will be understood by those or ordinary skill in the art. The thermoplastic polymer component can contain a single polymer species or a blend of two or more non-starch thermoplastic polymers. Additionally, other materials, including but not limited to thermoplastic starch, can be present in the thermoplastic polymer component. Typically, non-starch, thermoplastic polymers are present in an amount of from about 51% to 100%, preferably from about 60% to about 95%, more preferably from about 70% to about 90%, by total weight of the thermoplastic polymer component.

Component B: Thermoplastic Starch

The present invention relates to the use of starch, a low cost naturally occurring biopolymer. The starch used in the present invention is thermoplastic, destructured starch. The term "destructurized starch" is used to mean starch that is no longer in its naturally occurring granular structure. The term "thermoplastic starch" or "TPS" is used to mean starch with a plasticizer for improving its thermoplastic flow properties so that it may be able to be spun into fibers. Natural starch does not melt or flow like conventional thermoplastic polymers. Since natural starch generally has a granular structure, it desirably should be "destructurized", or "destructured", before it can be melt processed and spun like a thermoplastic material. Without intending to be bound by theory, the granular structure of starch is characterized by granules comprising a structure of discrete amylopectin and amylose regions in a starch granule. This granular structure is broken down during destructurization, which can be followed by a volume expansion of the starch component in he presence of the solvent or plasticizer. Starch undergoing destructuring in the presence of the solvent or plasticizer also typically has an increase in viscosity versus non-destructured starch with the solvent or plasticizer. The resulting destructurized starch can be in gelatinized form or, upon drying and or annealing, in crystalline form. However once broken down the natural granular structure of starch will not, in general, return. It is desirable that the starch be fully destructured such that no lumps impacting the fiber spinning process are present. The destructuring agent used to destructure the starch may remain with the starch during further processing, or may be transient, in that it is removed such that it does not remain in the fiber spun with the starch.

Starch can be destructured in a variety of different ways. The starch can be destructurized with a solvent. For example, starch can be destructurized by subjecting a mixture of the starch and solvent to heat, which can be under pressurized conditions and shear, to gelatinize the starch, leading to destructurization. Solvents can also act as plasticizers and may be desirably retained in the composition to perform as a plasticizer during later processing. A variety of plasticizing agents that can act as solvents to destructure starch are described herein. These include the low molecular weight or monomeric plasticizers, such as but not limited to hydroxyl-containing plasticizers, including but not limited to the polyols, e.g. polyols such as mannitol, sorbitol, and glycerin. Water also can act as a solvent and plasticizer for starch.

For starch to flow and be melt spinnable like a conventional thermoplastic polymer, it should have plasticizer present. If the destructuring agent is removed, it is the nature of the starch to in general remain destructured, however a plasticizer should be added to or otherwise included in the starch component to impart thermoplastic properties to the starch component in order to facilitate fiber spinning. Thus, the plasticizer present during spinning may be the same one used to destructure the starch. Alternately, especially when the destructuring agent is transient as described above (for example water), a separate or additional plasticizer may be added to the starch. Such additional plasticizer can be added prior to, during, or after the starch is destructured, as long as it remains in the starch for the fiber spinning step.

Suitable naturally occurring starches can include, but are not limited to, corn starch (including, for example, waxy maize starch), potato starch, sweet potato starch, wheat starch, sago palm starch, tapioca starch, rice starch, soybean starch, arrow root starch, bracken starch, lotus starch, cassava starch, high amylose corn starch, and commercial amylose powder. Blends of starch may also be used. Though all starches are useful herein, the present invention is most commonly practiced with natural starches derived from agricultural sources, which offer the advantages of being abundant in supply, easily replenishable and inexpensive in price. Naturally occurring starches, particularly corn starch (including, for example, waxy maize starch), and wheat starch, are starch polymers of choice due to their economy and availability. Modified starch may also be used. Modified starch is defined as non-substituted, or substituted, starch that has had its native molecular weight characteristics changed (i.e. the molecular weight is changed but no other changes are necessarily made to the starch). Molecular weight can be modified, preferably reduced, by any technique numerous of which are well known in the art. These include, for example, chemical modifications of starch by, for example, acid or alkali hydrolysis, acid reduction, oxidative reduction, enzymatic reduction, physical/mechanical degradation (e.g., via the thermomechanical energy input of the processing equipment), or combinations thereof. The thermomechanical method and the oxidation method offer an additional advantage when carried out in situ. The exact chemical nature of the starch and molecular weight reduction method is not critical as long as the average molecular weight is provided at the desired level or range. Such techniques can also reduce molecular weight distribution.

Natural, unmodified starch generally has a very high average molecular weight and a broad molecular weight distribution (e.g. natural corn starch has an average molecular weight of up to about 60,000,000 grams/mole (g/mol)). It is desirable to reduce the molecular weight of the starch for use in the present invention. Molecular weight reduction can be obtained by any technique known in the art, including those discussed above. Ranges of molecular weight for destructured starch or starch blends added to the melt can be from about 3,000 g/mol to about 8,000,000 g/mol, preferably from about 10,000 g/mol to about 5,000,000 g/mol, and more preferably from about 20,000 g/mol to about 3,000,000 g/mol.

Optionally, substituted starch can be used. Chemical modifications of starch to provide substituted starch include, but are not limited to, etherification and esterification. For example, methyl, ethyl, or propyl (or larger aliphatic groups) can be substituted onto the starch using conventional etherification and esterification techniques as well known in the art. Such substitution can be done when the starch is in natural, granular form or after it has been destructured. It will be appreciated that substitution can reduce the rate of biodegradability of the starch, but can also reduce the time, temperature, shear, and/or pressure conditions for destructurization. The degree of substitution of the chemically substituted starch is typically, but not necessarily, from about 0.01 to about 3.0, and can also be from about 0.01 to about 0.06.

Typically, the thermoplastic starch comprises from about 51% to about 100%, preferably from about 60% to about 95%, more preferably from about 70% to about 90% by weight of the thermoplastic starch component. The ratio of the starch component to the thermoplastic polymer will determine the percent of thermoplastic starch in the bicomponent fiber component. The weight of starch in the composition includes starch and its naturally occurring bound water content. The term "bound water" means the water found naturally occurring in starch and before mixing of starch with other components to make the composition of the present invention. The term "free water" means the water that is added in making the composition of the present invention. A person of ordinary skill in the art would recognize that once the components are mixed in a composition, water can no longer be distinguished by its origin. Natural starch typically has a bound water content of about 5% to about 16% by weight of starch.

Plasticizer

One or more plasticizers can be used in the present invention to destructurize the starch and enable the starch to flow, i.e. create a thermoplastic starch. As discussed above, a plasticizer may be used as a destructuring agent for he starch. That plasticizer may remain in the destructured starch component to function as a plasticizer for the thermoplastic starch, or may be removed and substituted with a different plasticizer in the thermoplastic starch component. The plasticizers may also improve the flexibility of the final products, which is believed to be due to the lowering of the glass transition temperature of the composition. A plasticizer or diluent for the thermoplastic polymer component may be present to lower the polymer's melting temperature, modify flexibility of the final product, or improve overall compatibility with the thermoplastic starch blend. Furthermore, thermoplastic polymers with higher melting temperatures may be used if plasticizers or diluents are present which suppress the melting temperature of the polymer.

In general, the plasticizers should be substantially compatible with the polymeric components of the present invention with which they are intermixed. As used herein, the term "substantially compatible" means when heated to a temperature above the softening and/or the melting temperature of the composition, the plasticizer is capable of forming a homogeneous mixture with polymer present in the component in which it is intermixed.

The plasticizers herein can include monomeric compounds and polymers. The polymeric plasticizers will typically have a molecular weight of about 100,000 g/mol or less. Polymeric plasticizers can include block copolymers and random copolymers, including terpolymers thereof. In certain embodiments, the plasticizer has a low molecular weight plasticizer, for example a molecular weight of about 20,000 g/mol or less, or about 5,000 g/mol or less, or about 1,000 g/mol or less. The plasticizers may be used alone or more than one plasticizer may be used in any particular component of the present invention.

The plasticizer can be, for example, an organic compound having at least one hydroxyl group, including polyols having two or more hydroxyls. Nonlimiting examples of useful hydroxyl plasticizers include sugars such as glucose, sucrose, fructose, raffinose, maltodextrose, galactose, xylose, maltose, lactose, mannose erythrose, and pentaerythritol; sugar alcohols such as erythritol, xylitol, malitol, mannitol and sorbitol; polyols such as glycerol (glycerin), ethylene glycol, propylene glycol, dipropylene glycol, butylene glycol, hexane triol, and the like, and polymers thereof; and mixtures thereof. Suitable plasticizers especially include glycerine, mannitol, and sorbitol.

Also useful herein hydroxyl polymeric plasticizers such as poloxomers (polyoxyethylene/polyoxypropylene block copolymers) and poloxamines (polyoxyethylene/polyoxypropylene block copolymers of ethylene diamine). These copolymers are available as Pluronic® from BASF Corp., Parsippany, N.J. Suitable poloxamers and poloxamines are available as Synperonic® from ICI Chemicals, Wilmington, Del., or as Tetronic® from BASF Corp., Parsippany, N.J. Also suitable for use are hydroxy-containing polymers such as polyvinyl alcohol, ethylene vinyl alcohol, and copolymers and blends thereof.

Also suitable for use herein are hydrogen bond forming organic compounds, including those which do not have hydroxyl group, including urea and urea derivatives; anhydrides of sugar alcohols such as sorbitan; animal proteins such as gelatin; vegetable proteins such as sunflower protein, soybean proteins, cotton seed proteins; and mixtures thereof. Other suitable plasticizers are phthalate esters, dimethyl and diethylsuccinate and related esters, glycerol triacetate, glycerol mono and diacetates, glycerol mono, di, and tripropionates, butanoates, stearates, lactic acid esters, citric acid esters, adipic acid esters, stearic acid esters, oleic acid esters, and other father acid esters which are biodegradable. Aliphatic acids such as ethylene acrylic acid, ethylene maleic acid, butadiene acrylic acid, butadiene maleic acid, propylene acrylic acid, propylene maleic acid, and other hydrocarbon based acids.

The amount of plasticizer is dependent upon the molecular weight and amount of starch and the affinity of the plasticizer for the starch or thermoplastic polymer. Any amount that effectively plasticizes the starch can be used. The plasticizer should sufficiently plasticize the starch component so that it can be processed effectively to form fibers. Generally, the amount of plasticizer increases with increasing molecular weight of starch. Typically, the plasticizer can be present in an amount of from about 2% to about 70%, and can also be from about 5% to about 55%, or from about 10% to about 50% of the component into which it is intermixed. Polymeric incorporated into the starch component that function as plasticizers for the starch shall be counted as part of the plasticizer constituent of that component of the present invention. Plasticizer is optional for the thermoplastic polymer components in the present invention at any effective levels, including the ranges above, and amounts below 2% are also included.

Optional Materials

Optionally, other ingredients may be incorporated into the thermoplastic starch and thermoplastic polymer composition. These optional ingredients may be present in quantities of about 49% or less, or from about 0.1% to about 30%, or from about 0.1% to about 10% by weight of the component.

The optional materials may be used to modify the processability and/or to modify physical properties such as elasticity, tensile strength and modulus of the final product. Other benefits include, but are not limited to, stability including oxidative stability, brightness, color, flexibility, resiliency, workability, processing aids, viscosity modifiers, and odor control. A preferred processing aid is magnesium stearate. Another optional material that may be desired, particularly in the starch component, is ethylene acrylic acid, commercially available as Primacore by Dow Chemical Company. Examples of optional ingredients are found in U.S. application Ser. No. 09/853,131.

(2) Configuration

The term multicomponent, as used herein, is defined as a fiber having more than one separate part in spatial relationship to one another at the exit from the extrusion equipment. Component, as used herein, is defined as a separate part of the fiber that has a spatial relationship to another part of the fiber. The fibers of the present invention are, at least, bicomponent fibers. The term multicomponent includes bicomponent, which is defined as a fiber having two separate parts in a spatial relationship to one another. The different components of multicomponent fibers are arranged in substantially distinct regions across the cross-section of the fiber and extend continuously along the length of the fiber.

As described above, either or both of the required components may be multiconstituent components. Constituent, as used herein, is defined as meaning the chemical species of matter or the material. Multiconstituent fiber, as used herein, is defined to mean a fiber, or component thereof, containing more than one chemical species or material.

The multicomponent fibers of the present invention may be in many different configurations.

As previously discussed, the multicomponent fibers of the present invention are splittable fibers. Rheological, thermal, and solidification differential behavior can potentially cause splitting. Splitting may also occur by a mechanical means such as ring-rolling, stress or strain, use of an abrasive, or differential stretching, and/or by fluid induced distortion, such as hydrodynamic or aerodynamic. Spunbond structures, staple fibers, hollow fibers, shaped fibers, such as multi-lobal fibers and multicomponent fibers can all be produced by using the compositions and methods of the present invention. The multicomponent fibers may be in a side-by-side, hollow segmented pie, segmented pie (i.e., solid segmented pie), ribbon, islands-in-the-sea configuration, tipped multilobal, or any combination thereof. The fibers of the present invention may have different geometries that include round, elliptical, star shaped, rectangular, triangular, and other various eccentricities. Various configuration of the splittable multicomponent fiber of the present invention are shown in the figures. Unless otherwise stated, Segment X in the figures described below may correspond to either the starch component or the thermoplastic polymer component, and Segment Y may correspond to either the starch component or the thermoplastic polymer component, however both X and Y shall not correspond to the same component.

FIG. 1 illustrates a solid eight segmented pie configuration.

Figure 2:
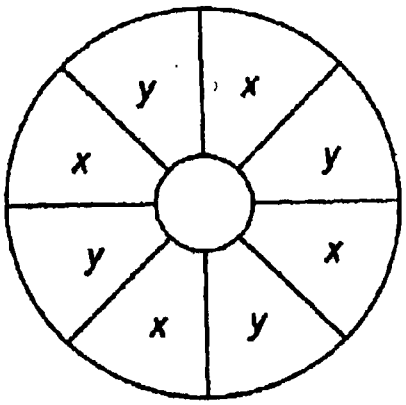
FIG. 2 is a cross-sectional view of a splittable fiber with a hollow eight segmented pie configuration.

FIG. 2 illustrates a hollow eight segmented pie configuration.

Figure 3:
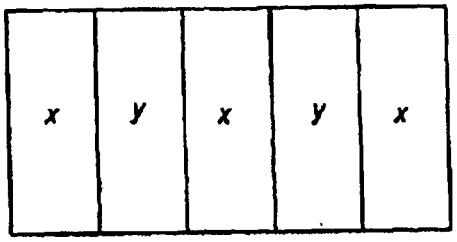
FIG. 3 is a cross-sectional view of a splittable fiber with a cross-sectional view of a bicomponent fiber having a ribbon configuration.

FIG. 3 is schematic drawing illustrating a cross-sectional view of a bicomponent fiber having a ribbon configuration.

FIG. 4 is schematic drawings illustrating a cross-sectional view of a bicomponent fiber having a side-by-side configuration.

Figure 4A:
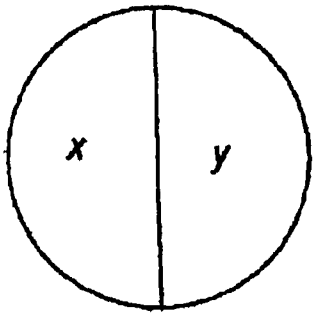
FIG. 4A is a cross-sectional view of a splittable fiber with a side-by-side configuration.

FIG. 4A illustrates a side-by-side configuration.

Figure 4B:
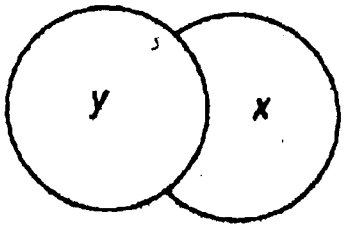
FIG. 4B is a cross-sectional view of a splittable fiber with a side-by-side configuration with a rounded adjoining line.

FIG. 4B illustrates a side-by-side configuration with a rounded adjoining line. The adjoining line is where two segments meet. Segment Y is present in a higher amount than Segment X.

Figure 4C:
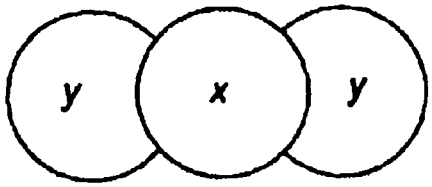
FIG. 4C is a cross-sectional view of a splittable fiber with a rounded adjoining line.

FIG. 4C is a side-by-side configuration with Segments Y being positioned on either side of Segment X with a rounded adjoining line.

Figure 4D:
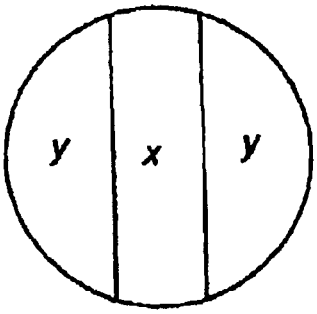
FIG. 4D is a cross-sectional view of a splittable fiber with a side-by-side configuration.

FIG. 4D is a side-by-side configuration with Segments Y being positioned on either side of Segment X.

Figure 4E:
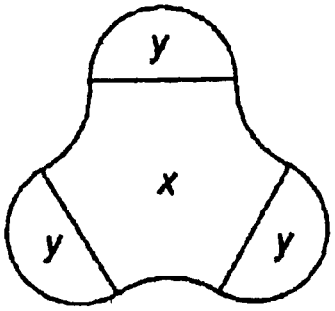
FIG. 4E is a cross-sectional view of a splittable fiber with a shaped side-by-side configuration.

FIG. 4E is a shaped side-by-side configuration with Y being positioned on the tips of X.

Figure 5:
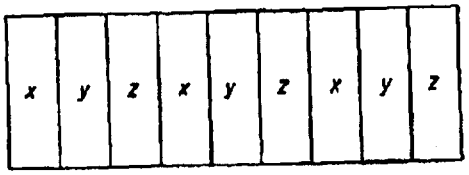
FIG. 5 is a cross-sectional view of a splittable fiber with a cross-sectional view of a tricomponent fiber.

FIG. 5 is schematic drawing illustrating a cross-sectional view of a tricomponent fiber having a ribbon configuration having Segments X, Y, and Z, wherein X and Y may be as described above, and Z may be another component that is splittable from X and/or Y.

There may be any number of distinct segments flow through a single spinneret hole; typically, without limitation, the number of segments can range from 2 to about 256, or alternately from 4 to about 400, or from 8 to about 164, or from about 16 to about 64. The ratio of the weight of the thermoplastic starch component to thermoplastic polymer component is generally from about 5:95 to about 95:5. For obtaining improved manufacturing efficiency of fibers made from the thermoplastic polymer component, the weight percentage of thermoplastic starch component, based on the total weight of the multicomponent fiber, can be lower than the weight percentage of thermoplastic polymer component, as this produces either more split fibers comprising the thermoplastic polymer or reduces the amount of the multicomponent fiber (starch component) that is removed. The weight ratio of thermoplastic starch component to the thermoplastic polymer component for such multicomponent fibers can be, for example, from about 10:90 to about 65:35, and alternately can be from about 15:85 to about 50:50. In other embodiments, wherein it is also desired to retain and use starch fibers split from the multicomponent fiber, the weight ratio of starch component to thermoplastic polymer component can be adjusted in for the multicomponent fiber as desired to provided the desired proportion and size of split starch component and thermoplastic polymer component fibers.

(3) Material Properties

Two types of fiber diameters can be referred to since the present invention relates to a splittable multicomponent fiber, as well as to split fibers obtained from the multicomponent fiber. The term "split fiber" is used to include fibers obtained upon separation, or splitting, of the multicomponent fiber into one or more fibers by separating one or more components of the multicomponent fiber. Splitting can be accomplished by any techniques in the art including, for example, chemical removal of a component, such as but not limiting to dissolving the component or by inclusion of an aid to facilitate separation of the components of the fiber, as well as mechanically removing a component, and combinations thereof. Mechanical splitting can be accomplished by application of force (including but not limited to drawing, hydroentangling, stretching etc.). Multicomponent fibers having components that are not highly compatible with one another may split naturally upon spinning of the fibers or upon normal handling of the fibers once formed. A component can be dissolved away by numerous techniques known in the art. These include, by way of example, exposure of the polymer to be dissolved with a plasticizer, or solvent or reactive medium (liquid or gas). Also, segments that are adjacent to one another that are made from components having significant differences in surface energy will tend to be more easily splittable, and may split naturally upon formation or upon exit from the spinneret capillary. Techniques for splitting multicomponent fibers are described in more detail below.

The first fiber diameter, referred to hereafter, is the "parent" or splittable multicomponent. When the parent fiber splits, it produces one or more "children" or split fibers that are smaller in diameter than the parent fiber. In general, the diameter of the splittable multicomponent fiber can be about 400 microns or less, and can also be about 200 microns or less, or about 100 microns or less. The diameter of the split fibers is always less than the diameter of the multicomponent fiber and generally is about 50 microns or less, and can also be about 40 microns or less, about 30 microns, or about 25 microns or less. The diameter of the split fibers typically can be about 2 microns or greater, and embodiments hereof can be about 5 microns or greater. Fiber diameter is controlled by parameters well known in the art including but not limited to spinning speed, mass throughput, and blend composition.

For non-round fibers, the diameter is determined as equivalent diameter. The equivalent diameter for each segment of a component, for example a component (i) ($d_{s1}$) in the fiber cross-section, where component (i) can be the thermoplastic polymer component or, in cases wherein the thermoplastic starch component also remains in fiber form subsequent to splitting, is calculated as follows:

$$A_T = F_p \frac{\pi d_f^2}{4}$$

where $A_T$ is the total area of polymer in the fiber cross-section, $F_p$ is the fraction of the fiber cross-section occupied by polymer (total minus the hollow center), and $d_f$ is the outer diameter of the fiber. The cross-sectional area of each segment of component i ($A_i$) is then calculated according to:

$$A_i = \frac{A_T X}{n}$$

where X is the fraction of component i in the fiber and n is the number of component i segments in the fiber (8 in the case of a 16-segment pie fiber).

The equivalent diameter of each segment of component i ($d_{s1}$) is then calculated by:

$$d_{sI} = \left(\frac{4A_i}{\pi}\right)^{0.5}$$

The parent fiber is defined as a fiber having a relatively low draw down ratio. The total fiber draw down ratio is defined as the ratio of the fiber at its maximum diameter (which is typically results immediately after exiting the capillary) to the final fiber diameter in its end use. The total parent fiber draw down ratio via either staple, spunbond, or meltblown process can be about 50 or less, and in embodiments hereof can be about 30 or less, or about 20 or less, or about 15 or less.

The fibers produced in the present invention may be environmentally degradable depending upon the amount of starch that is present, the polymer used, and the specific configuration of the fiber. "Environmentally degradable" is defined as being biodegradable, disintegratable, dispersible, flushable, or compostable or a combination thereof. In the present invention, the fibers, nonwoven webs, and articles may be environmentally degradable.

The fibers described herein are typically used to make disposable nonwoven articles. The articles are commonly flushable. The term "flushable" as used herein refers to materials which are capable of dissolving, dispersing, disintegrating, and/or decomposing in a septic disposal system such as a toilet to provide clearance when flushed down the toilet without clogging the toilet or any other sewage drainage pipe. The fibers and resulting articles may also be aqueous responsive. The term aqueous responsive as used herein means that when placed in water or flushed, an observable and measurable change will result. Typical observations include noting that the article swells, pulls apart, dissolves, or observing a general weakened structure The multicomponent and split fibers of the present invention can have low brittleness and have high toughness, for example a toughness of about 2 MPa or greater. Toughness is defined as the area under the stress-strain curve.

The split fibers of the present invention corresponding to the non-starch thermoplastic polymer containing component of the present invention have enhanced extensibility or elongation. Extensibility or elongation is measured by elongation to break. Extensibility or elongation is defined as being capable of elongating under an applied force, but not necessarily recovering. Elongation to break is measured as the distance the fiber can be stretched until failure.

The elongation to break of the fibers hereof are tested according to ASTM standard D3822 except a strain rate of 200%/min is used. Testing is performed on an MTS Synergie 400 tensile testing machine with a 10 N load cell and pneumatic grips. Tests are conducted at a rate of 2 inches/minute on samples with a 1-inch gage length. Samples are pulled to break. Peak stress and % elongation at break are recorded and averaged for 10 specimens. The "Elongation to Break" of a fiber is defined as the elongation to break measured according to the above described test and conditions.

The Elongation to Break Ratio of the split fibers of the present invention is defined as the Elongation to Break of the split fiber of the present invention divided by the Elongation to Break of a monocomponent fiber made from the same composition as the split fiber under essentially identical fiber spinning conditions and parameters except as provided below. The mass throughput of the monocomponent fiber should be the same as the total mass throughput as the corresponding component of the multicomponent fiber. For example, if the total mass through-put for thermoplastic polymer component is "x", and the multicomponent contains three (3) split fiber-forming segments, the mass through-put for forming the monocomponent fiber should still be "x". The diameter of the monocomponent fiber should be the same as the equivalent diameter of the split fiber. As will be understood in the art, spinning speed for the monocomponent fiber may be higher than spinning speed for the multicomponent fiber, particularly when the multicomponent fiber contains two or split fiber-forming segments. The dimensions of the spinneret capillary used to prepare the monocomponent fiber should be the same as that used to prepare the multicomponent fiber. The Elongation to Break Ratio for the split fibers corresponding to the thermoplastic polymer component of the multicomponent fibers of the present invention should be greater than 1.0, and can be about 1.5 or greater, or about 2.0 or greater. A benefit of the present invention is that small diameter fibers can be produced that are highly extensible at relatively high mass throughput. This is a benefit compared to conventional processes of making small diameter fibers directly as monocomponent fibers, wherein cost effective, high spinning speed/mass through-put processes for narrow fibers tends to result in low extensibility, or low spinning speed/mass through-put processes that can produce improved extensibility are not efficient.

Nonwoven products produced from the fibers of the present invention can exhibit desirable mechanical properties, particularly, strength, flexibility, softness, and absorbency. Measures of strength include dry and/or wet tensile strength. Flexibility is related to stiffness and can attribute to softness. Softness is generally described as a physiologically perceived attribute which is related to both flexibility and texture. Generally, smaller fiber diameters will result in softer nonwoven products. Absorbency relates to the products' ability to take up fluids as well as the capacity to retain them.

Typically, the split fibers corresponding to the thermoplastic polymer component of the multicomponent fibers of the present invention will be provided by the present inventions. However, in embodiments wherein the starch component is mechanically removed from the multicomponent fiber, or wherein the starch component separates naturally from the multicomponent fiber upon formation, the present inventions may also provide split fibers of the thermoplastic starch component. These may be used in combination with or separate from the thermoplastic polymer component split fibers.

(4) Processes

The first step in producing a multicomponent fiber can be a compounding or mixing step. In the compounding step, the raw materials are heated, typically under shear. The shearing in the presence of heat can result in a homogeneous melt with proper selection of the composition. The melt is then placed in an extruder where fibers are formed. A collection of fibers is combined together using heat, pressure, chemical binder, mechanical entanglement, and combinations thereof resulting in the formation of a nonwoven web. The nonwoven is then assembled into an article.

Compounding

The objective of the compounding step is to produce a homogeneous melt composition for each component of the fibers. Preferably, the melt composition is homogeneous, meaning that a uniform distribution of ingredients in the melt is present. The resultant melt composition(s) should be essentially free of water to spin fibers. Essentially free is defined as not creating substantial problems, such as causing bubbles to form which may ultimately break the fiber while spinning. The free water content of the melt composition can be about 1% or less, about 0.5% or less, or about 0.15% of less. The total water content includes the bound and free water. Preferably, the total water content (including bound water and free water) is about 1% or less. To achieve this low water content, the starch or polymers may need to be dried before processed and/or a vacuum is applied during processing to remove any free water. The thermoplastic starch, or other components hereof, can be dried at elevated temperatures, such as about 60° C., before spinning. The drying temperature is determined by the chemical nature of a component's constituents. Therefore, different compositions can use different drying temperatures which can range from 20° C. to 150° C. and are, in general, below the melting temperature of the polymer. Drying of the components may, for example, be in series or as discrete steps combined with spinning. Such techniques for drying as are well known in the art can be used for the purposes of this invention.

In general, any method known in the art or suitable for the purposes hereof can be used to combine the ingredients of the components of the present invention. Typically such techniques will include heat, mixing, and pressure. The particular order or mixing, temperatures, mixing speeds or time, and equipment can be varied, as will be understood by those skilled in the art, however temperature should be controlled such that the starch does not significantly degrade. The resulting melt should be homogeneous. A suitable method of mixing for a starch and plasticizer blend is as follows:

1. The starch is destructured by addition of a plasticizer. The plasticizer, if solid such as sorbitol or mannitol, can be added with starch (in powder form) into a twin-screw extruder. Liquids such as glycerine can be combined with the starch via volumetric displacement pumps.
2. The starch is fully destructurized by application of heat and shear in the extruder. The starch and plasticizer mixture is typically heated to 120–180° C. over a period of from about 10 seconds to about 15 minutes, until the starch gelatinizes.
3. A vacuum can applied to the melt in the extruder, typically at least once, to remove free water. Vacuum can be applied, for example, approximately two-thirds of the way down the extruder length, or at any other point desired by the operator.
4. Alternatively, multiple feed zones can be used for introducing multiple plasticizers or blends of starch.
5. Alternatively, the starch can be premixed with a liquid plasticizer and pumped into the extruder.

As will be appreciated by one skilled in the art of compounding, numerous variations and alternate methods and conditions can be used for destructuring the starch and formation of the starch melt including, without limitation, via feed port location and screw extruder profile.

A suitable mixing device is a multiple mixing zone twin screw extruder with multiple injection points. The multiple injection points can be used to add the destructurized starch and the polymer. A twin screw batch mixer or a single screw extrusion system can also be used. As long as sufficient mixing and heating occurs, the particular equipment used is not critical.

An alternative method for compounding the materials comprises adding the plasticizer, starch, and polymer to an extrusion system where they are mixed in progressively increasing temperatures. For example, in a twin screw extruder with six heating zones, the first three zones may be heated to 90°, 120°, and 130° C., and the last three zones will be heated above the melting point of the polymer. This procedure results in minimal thermal degradation of the starch and for the starch to be fully destructured before intimate mixing with the thermoplastic materials.

An example of compounding destructured thermoplastic starch would be to use a Werner & Pfleiderer (30 mm diameter 40:1 length to diameter ratio) co-rotating twin-screw extruder set at 250 RPM with the first two heat zones set at 50° C. and the remaining five heating zones set 150° C. A vacuum is attached between the penultimate and last heat section pulling a vacuum of 10 atm. Starch powder and plasticizer (e.g., sorbitol) are individually fed into the feed throat at the base of the extruder, for example using mass-loss feeders, at a combined rate of 30 lbs/hour (13.6 kg/hour) at a 60/40 weight ratio of starch/plasticizer. Processing aids can be added along with the starch or plasticizer. For example, magnesium separate can be added, for example, at a level of 0–1%, by weight, of the thermoplastic starch component.

Spinning

The fibers of the present invention can be made by melt spinning. Melt spinning is differentiated from other spinning, such as wet or dry spinning from solution, where in such alternate methods a solvent is present in the melt and is eliminated by volatilizing or diffusing it out of the extrudate.

Spinning temperatures for the melts can range from about 105° C. to about 300° C., and in some embodiments can be from about 130° C. to about 250° C. or from about 150° C. to about 210° C. The processing temperature is determined by the chemical nature, molecular weights and concentration of each component.

In general, high fiber spinning rates are desired for the present invention. Fiber spinning speeds of about 10 meters/minute or greater can be used. In some embodiments hereof, the fiber spinning speed is from about 100 to about 7,000 meters/minute, or from about 300 to about 3,000 meters/minute, or from about 500 to about 2,000 meters/minute.

The fiber may be made by fiber spinning processes characterized by a high draw down ratio. The draw down ratio is defined as the ratio of the fiber at its maximum diameter (which is typically occurs immediately after exiting the capillary of the spinneret in a conventional spinning process) to the final diameter of the formed fiber. The fiber draw down ratio via either staple, spunbond, or meltblown process will typically be 1.5 or greater, and can be about 5 or greater, about 10 or greater, or about 12 or greater.

Continuous fibers can be produced through, for example, spunbond methods or meltblowing processes. Alternately, non-continuous (staple fibers) fibers can be produced according to conventional staple fiber processes as are well known in the art. The various methods of fiber manufacturing can also be combined to produce a combination technique, as will be understood by those skilled in the art. Hollow fibers, for example, can be produced as described in U.S. Pat. No. 6,368,990. Such methods as mentioned above for fiber spinning are well known and understood in the art. The fibers spun can be collected subsequent for formation using conventional godet winding systems or through air drag attenuation devices. If the godet system is used, the fibers can be further oriented through post extrusion drawing at temperatures from about 50° to about 200° C. The drawn fibers may then be crimped and/or cut to form non-continuous fibers (staple fibers) used in a carding, airlaid, or fluidlaid process.

In the process of spinning fibers, particularly as the temperature is increased above 105° C., typically it is desirable for residual water levels to be 1%, by weight of the fiber, or less, alternately 0.5% or less, or 0.15% or less.

Suitable multicomponent melt spinning equipment is commercially available from, for example, Hills Inc. located in Melbourne, Fla. U.S.A. and is described in U.S. Pat. No. 5,162,074 (Hills, Inc.).

The spinneret capillary dimensions can vary depending upon desired fiber size and design, spinning conditions, and polymer properties. Suitable capillary dimensions include, but are not limited to, length-to-diameter ratio of 4 with a diameter of 0.350 mm.

As will be understood by one skilled in the art, spinning of the fibers and compounding of the components can optionally be done in-line, with compounding, drying and spinning being a continuous process.

The residence time of each component in the spinline can have special significance when a high melting temperatures thermoplastic polymer is chosen to be spun with destructured starch. Spinning equipment can be designed to minimize the exposure of the destructured starch component to high process temperature by minimizing the time and volume of destructured exposed in the spinneret. For example, the polymer supply lines to the spinneret can be sealed and separated until introduction into the bicomponent pack. Furthermore, one skilled in the art of multicomponent fiber spinning will understand that the at least two components can be introduced and processed in their separate extruders at different temperatures until introduced into the spinneret.

For example, a suitable process for spinning bicomponent, segmented pie fiber with at least one destructured starch segment and at least one polypropylene segment is as follows. The destructured starch component extruder profile may be 80° C., 150° C. and 150° C. in the first three zones of a three heater zone extruder with a starch composition similar to Example 5. The transfer lines and melt pump heater temperatures may be 150° C. for the starch component. The polypropylene component extruder temperature profile may be 180° C., 230° C. and 230° C. in the first three zones of a three heater zone extruder. The transfer lines and melt pump can be heated to 230° C. In this case the spinneret temperature can range from 180° C. to 230° C.

Splitting of the fibers can be accomplished in a variety of manners. In one embodiment, the multicomponent fiber splits into the split fibers upon formation or upon exit from the capillary of the spinneret, without the application of fiber splitting techniques other than the conditions inherently present in the fiber spinning process. When the fiber velocity has reaches zero, split fibers can already be present. Such fiber splitting results from differences in rheology, compatability or solidification kinetics of the different components of the adjacent segments of the multicomponent fiber. Components with substantially different surface energy will tend to split from one another with application of low levels of force, such as present during the normal fiber spinning process. Polypropylene, for example, has low surface energy compared unsubstituted starch, and can form multicomponent fibers with unsubstituted starch wherein the split fibers naturally form upon exit from the spinneret capillary. Differences in polymer component elongation or stiffness may also enhance the splitting off the multicomponent fibers upon exit from the spinneret. For example, reducing starch molecular weight tends to increase brittleness of the starch, thereby increasing the difference in elongation properties between the starch and the thermoplastic polymer and increasing the ability of he multicomponent fiber to split upon exit from the spinneret.

For instance, in a 16-segmented pie, 16 individual fibers will be present instead of one large fiber for each capillary. The starch component fibers can be retained, if desired, or removed via solvent extraction, mechanical destruction via needle punching, high pressure fluid exposure or any other suitable means. In a second embodiment, one or more components of the multicomponent fiber is separated from the multicomponent fiber by application of a post fiber formation step, which can be application of mechanical energy, thereby also providing least one component in the form of split fibers. The fibers can be split via mechanical deformation without removal of the starch component in addition to the methods described above for starch component removal in a fiber after it has been split. The mechanical deformation may come from, for example, elongation, bending, shearing on the surfaces of the fiber (abrasion for instance) or any other suitable method. The starch component fibers retained, if desired, or removed via solvent extraction, mechanical destruction, e.g., via needle punching, high pressure fluid exposure or any other suitable means. In one exemplary embodiment, the starch component constituents are formulated such that the starch component is very brittle, which makes mechanical removal of the starch component easier.

In another embodiment, one or more components, typically including the starch component, can be separated from the multicomponent fiber, leaving at least one component in the form of split fibers. Starch can be dissolved in a solvent, such as for example water or other polar solvent (e.g., C1–C3 alcohol), such that fibers (nonwoven and woven are herby incorporated hereafter for any removal operation) can be passed through a solvent bath or sprayed with a high pressure fluid solvent to remove the starch component.

Also, combinations of the above embodiments may be present in or applied to the multicomponent fibers. Other methods as may be known to those in the art may also be used. These fibers can be further treated if desired with application of finishes or impregnated with other materials.

(5) Articles

The split fibers may be converted to fibrous webs and nonwovens by any suitable method known in the art. Nonwoven substrates may be formed, for example, utilizing a variety of different bonding methods. Continuous fibers can be formed into a web using industry standard spunbond or meltblown type technologies while staple fibers can be formed into a web using industry standard carding, airlaid, or wetlaid technologies. Typical bonding methods include: calendar (pressure and heat), thru-air heat, mechanical entanglement, hydrodynamic entanglement, needle punching, and chemical bonding and/or resin bonding. Thermally bondable fibers are required for the pressurized heat and thru-air heat bonding methods. The nonwoven webs and substrates hereof can be made using the thermoplastic polymer component split fibers, the starch component split fibers, or a combination thereof. Additionally, the split fibers of the present invention can be combined with other fibers known in the art including, but not limited to, synthetic fibers and natural fibers. The split fibers hereof can be used for any purposes known in the art for fibers comprising the constituents included in the split fibers obtained according to the present invention.

For example, the split fibers of the present invention may also be bonded or combined with other synthetic or natural fibers to make nonwoven articles. The synthetic or natural fibers may be blended together in the forming process or used in discrete layers. Suitable synthetic fibers include fibers made from polypropylene, polyethylene, polyester, polyacrylates, and copolymers thereof and mixtures thereof. Natural fibers include cellulosic fibers and derivatives thereof. Suitable cellulosic fibers include those derived from any tree or vegetation, including hardwood fibers, softwood fibers, hemp, and cotton. Also included are fibers made from processed natural cellulosic resources such as rayon.

As discussed above, the split fibers of the present invention may be used to make nonwovens, including but not limited to those that contain 15%, by weight, or greater, of a plurality of fibers that are continuous or non-continuous and physically and/or chemically attached to one another. The nonwoven may be in the form of a protective layer, a barrier layer, a liquid and/or air impervious layer, or an absorbent core or web. The nonwoven may be combined with additional nonwovens or films to produce a layered product used either by itself or as a component in a complex combination of other materials, such as a baby diaper or feminine care pad. A particular embodiment contemplated herein includes disposable, nonwoven articles. The products may find use in one of many different uses. Suitable articles of the present invention include disposable nonwovens for hygiene, cleansing, surface treatment, and medical applications. Hygiene applications include such items as wipes; diapers, particularly the top sheet or back sheet or as a protective layer covering elastics or other components of the diaper; and feminine pads or products, particularly the top sheet or backsheet.

EXAMPLES

The examples below further illustrate the present invention. The starches for use in the examples below are StarDri 1, StarDri 100, Ethylex 2015, or Ethylex 2035, all from Staley Chemical Co. The latter Staley materials are substituted starches. The polypropylenes (PP) are Basell Profax PH-835, Basell PDC 1298, or Exxon/Mobil Achieve 3854. The polyethylenes (PE) are Dow Chemicals Aspun 6811A, Dow Chemical Aspun 6830A, or Dow Chemical Aspun 6842A. The glycerine is from Dow Chemical Company, Kosher Grade BUM OPTIM* Glycerine 99.7%. The sorbitol is from Archer-Daniels-Midland Co. (ADM), Crystalline NF/FCC 177440-2S. The polyethylene acrylic acid is PRIMACOR 5980I from Dow Chemical Co. Other polymers having similar chemical compositions that differ in molecular weight, molecular weight distribution, and/or co-monomer or defect level can also be used. The process condition in Comparative Example 1 and Examples 1–12 use a mass through put of 0.8 ghm. The typical range of mass throughput is from about 0.1 to about 8 ghm.

Comparative Example 1

Solid polypropylene (PP) monocomponent fibers composed of Basell Profax PH-835 are prepared at a through-put of 0.8 grams per hole per minute (ghm) had an elongation-to-break of 181% when the fiber diameter was 18 $\mu$m when melt spun into fibers via a continuous filament process at a melt extrusion temperature of 190° C.

Example 1

Hollow Segmented Pie

The bicomponent pack set-up contains 16-segmented pie configuration. Component A is Basell Profax PH-835. Component B is the TPS component and is compounded using 60 parts StarDri 1, 40 parts sorbitol, 15 parts Primacore 5980-I, and 1 part Magnesium Stearate. Each ingredient is added concurrently to an extrusion system where they are melted and mixed in progressively increasing temperatures. This procedure minimizes the thermal degradation to the starch that occurs when the starch is heated above 180° C. for significant periods of time. The spinneret processing temperature is 190° C. The ratio of Component A to B is 4:1. The mass throughput is 0.8 ghm. The fiber velocity via mechanical winding is 500 meters/minute (m/min). Component A readily splits from Component B under mechanical deformation. When the elongation-to-break is measured in the composite fiber, the value is 643% at an average Component A filament diameter of 16 $\mu$m. Thus when the fiber elongation is compared with Comparative Example 1, the elongation-to-break is significantly higher in Example 1 at a smaller overall diameter at equivalent mass throughput. The TPS component, Component B, can be readily removed via submersion in water to yield 8 PP fibers with similar elongation as the multicomponent fiber.

Example 2

Hollow Segmented Pie

The bicomponent pack set-up contains 16-segmented pie configuration. Component A is Basell Profax PH-835. Component B is the TPS component and is compounded using 60 parts StarDri 1, 40 parts sorbitol, and I part Magnesium Stearate. Each ingredient is added concurrently to an extrusion system where they are melted and mixed in progressively increasing temperatures. This procedure minimizes the thermal degradation to the starch that occurs when the starch is heated above 180° C. for significant periods of time. The spinneret processing temperature is 190° C. The ratio of Component A to B is 2.33:1. The mass throughput is 0.8 ghm. The fiber velocity via mechanical winding is 500 m/min. Component A readily splits from Component B under mechanical deformation. When the elongation-to-break is measured in the composite fiber, the value is 678% at an average Component A filament diameter of 16 $\mu$m. Thus when the fiber elongation is compared with Comparative Example 1, the elongation-to-break is significantly higher in Example 1 at a smaller overall diameter. The TPS component, Component B, can be readily removed via submersion in water to yield 8 PP fibers with similar elongation as the multicomponent fiber.

Example 3

Hollow Segmented Pie

The bicomponent pack set-up contains 16-segmented pie configuration. Component A is Basell Profax PH-835. Component B is the TPS component and is compounded using 60 parts StarDri 1, 40 parts sorbitol, and 1 part Magnesium Stearate. Each ingredient is added concurrently to an extrusion system where they are melted and mixed in progressively increasing temperatures. This procedure minimizes the thermal degradation to the starch that occurs when the starch is heated above 180° C. for significant periods of time. The spinneret processing temperature is 190° C. The ratio of Component A to B is 9:1. The mass throughput is 0.7 ghm. The fiber velocity via mechanical winding is 500 m/min. Component A readily splits from Component B under mechanical deformation. When the elongation-to-break is measured in the composite fiber, the value is 620% at an average Component A filament diameter of 16 $\mu$m. Thus when the fiber elongation is compared with Comparative Example 1, the elongation-to-break is significantly higher in Example 1 at a smaller overall diameter. The TPS component, Component B, can be readily removed via submersion in water to yield 8 PP fibers with similar elongation as the multicomponent fiber.

Example 4

Hollow Segmented Pie

The bicomponent pack set-up contains 16-segmented pie configuration. Component A is Basell Profax PH-835. Component B is the TPS component and is compounded using 60 parts StarDri 1, 40 parts sorbitol, and 1 part Magnesium Stearate. Each ingredient is added concurrently to an extrusion system where they are melted and mixed in progressively increasing temperatures. This procedure minimizes the thermal degradation to the starch that occurs when the starch is heated above 180° C. for significant periods of time. The spinneret processing temperature is 190° C. The ratio of Component A to B is 1:1. The mass throughput is 1.2 ghm. The fiber velocity via mechanical winding is 500 m/min. Component A readily splits from Component B under mechanical deformation. When the elongation-to-break is measured in the composite fiber, the value is 790% at an average Component A filament diameter of 16 $\mu$m. Thus when the fiber elongation is compared with Comparative Example 1, the elongation-to-break is significantly higher in Example 1 at a smaller overall diameter. The TPS component, Component B, can be readily removed via submersion in water to yield 8 PP fibers with elongation as the multicomponent fiber.

Example 5

Hollow Segmented Pie

The bicomponent pack set-up contains 16-segmented pie configuration. Component A is Basell Profax PH-835. Component B is the TPS component and is compounded using 60 parts StarDri 1, 40 parts sorbital.12 parts Dow Primacore 5980I, and 1 part Magnesium Stearate. Each ingredient is added concurrently to an extrusion system where they are melted and mixed in progressively increasing temperatures. This procedure minimizes the thermal degradation to the starch that occurs when the starch is heated above 180° C. for significant periods of time. The spinneret processing temperature is 190° C. The ratio of Component A to B is 4:1. The mass throughput is 0.8 ghm. The fiber velocity via mechanical winding is 500 m/min. Component A readily splits from Component B under mechanical deformation. When the elongation-to-break is measured in the composite fiber, the value is 640% at an average Component A filament diameter of 16 $\mu$m. Thus when the fiber elongation is compared with Comparative Example 1, the elongation-to-break is significantly higher in Example 1 at a smaller overall diameter at equivalent mass throughput. The TPS component, Component B, can be readily removed via submersion in water to yield 8 PP fibers with similar elongation as the multicomponent fiber.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A splittable multicomponent fiber comprising:

A. at least one nonencompassed segment of a first component comprising non-starch thermoplastic polymer;

B. at least one nonencompassed segment of a second component comprising thermoplastic starch;

wherein: (i) said second component is capable of being split or removed from said first component to provide at least one split fiber consisting essentially of said first component; and (ii) wherein the split fiber of said first component has an Elongation to Break Ratio of greater than 1.0.

2. The splittable multicomponent fiber of claim 1 wherein the splittable multicomponent fiber has a configuration selected from the group consisting of island-in-the-sea, segmented pie, hollow segmented pie, side-by-side, segmented ribbon, tipped multilobal, and combinations thereof.

3. The multicomponent fiber of claim 1 wherein the splittable multicomponent fiber has a diameter of about 400 micrometers or less.

4. The multicomponent fiber of claim 3 wherein said first component comprises a plurality of discrete segments, and each of said segments have a diameter of about 50 micrometers or less.

5. The multicomponent fiber of claim 4, wherein the diameter of said segments is about 25 micrometers or less.

6. The splittable multicomponent fiber of claim 1 wherein the thermoplastic polymer of Component A is selected from the group consisting of polyolefins, polyesters, polyamides, and copolymers and combinations thereof.

7. The splittable multicomponent fiber of claim 1, wherein said thermoplastic starch comprises destructured starch and a plasticizer.

8. The splittable multicomponent fiber of claim 1 wherein Component A also comprises up to about 49% starch.

9. The splittable multicomponent fiber of claim 1, wherein said Component B comprises up to about 49%, by weight, of a non-starch thermoplastic polymer.

10. The splittable multicomponent fiber of claim 1, wherein the Elongation to Break Ratio is about 1.5 or greater.

11. The splittable multicomponent fiber of claim 1, wherein the Elongation to Break Ratio is about 2.0 or greater.

12. Split fibers derived from the splittable multicomponent fiber of claim 1.

13. The split fibers of claim 12, wherein said split fibers are derived from said first component.

14. The split fibers of claim 13, wherein said split fibers further comprise split fibers derived from said second component.

15. The split fibers of claim 11, wherein said split fibers are derived from said multicomponent fibers by mechanically separating said split fibers from said multicomponent fiber.

16. Split fibers made by the process of claim 15.

17. A nonwoven web comprising the split fibers of claim 12.

18. A disposable article comprising the nonwoven web of claim 17.

* * * * *

UNITED STATES PATENT AND TRADEMARK OFFICE

CERTIFICATE OF CORRECTION

PATENT NO. : 6,743,506 B2
DATED : June 1, 2004
INVENTOR(S) : Bond et al.

It is certified that error appears in the above-identified patent and that said Letters Patent is hereby corrected as shown below:

Title page,
Item [63], Related Application Data, should read:
-- Continuation-in-part of application No. 09/853,131, filed on May 10, 2001, now abandoned, which is a continuation-in-part of application No. 09/852,888, filed on May 10, 2001. --

Signed and Sealed this

Eighth Day of February, 2005

JON W. DUDAS
*Director of the United States Patent and Trademark Office*